US011317189B2

(12) United States Patent
Zhu

(10) Patent No.: US 11,317,189 B2
(45) Date of Patent: Apr. 26, 2022

(54) DETACHABLE EARPHONE AND HEADBAND WITH EARPHONES

(71) Applicant: Xueping Zhu, Chenzhou (CN)

(72) Inventor: Xueping Zhu, Chenzhou (CN)

( * ) Notice: Subject to any disclaimer, the term of this patent is extended or adjusted under 35 U.S.C. 154(b) by 0 days.

(21) Appl. No.: 17/075,660

(22) Filed: Oct. 20, 2020

(65) Prior Publication Data

US 2022/0060810 A1 Feb. 24, 2022

(30) Foreign Application Priority Data

Sep. 23, 2020 (CN) ..... 202022102121.0

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
CPC .... H04R 1/1066; H04R 1/083; H04R 1/1008; H04R 1/1041; H04R 5/0335; H04R 1/1016; H04R 2201/107
See application file for complete search history.

(56) References Cited

U.S. PATENT DOCUMENTS

2004/0229667 A1 11/2004 Tsai
2009/0208040 A1* 8/2009 Planansky ..... A42B 1/245 381/301
2013/0022227 A1 1/2013 Wu et al.
2016/0198254 A1* 7/2016 Gecawicz ..... H04R 1/1058 381/375
2018/0027319 A1 1/2018 Yang

* cited by examiner

*Primary Examiner* — Amir H Etesam

(57) ABSTRACT

The present disclosure discloses a detachable earphone and a headband with earphones. A detachable earphone comprises an earphone body and an installing base, one side of the earphone body is provided with a clamping base on the same body, one side of the installing base is provided with an installing ring that matches with the clamping base, the clamping base is clamped on the side wall of the installing ring, the outer side of the clamping base is provided with an L-shaped neck, a clamping block is fixedly installed on the side wall of the installing ring, and the other side of the installing base is provided with a conical clamping ring protruding to the inside of the installing base; the present disclosure is provided with an installing base, a clamping base, an installing ring, an L-shaped neck and a clamping block.

5 Claims, 5 Drawing Sheets

DETACHABLE EARPHONE AND HEADBAND WITH EARPHONES

TECHNICAL FIELD

The present disclosure relates to the technical field of earphones, in particular to a detachable earphone and a headband with earphones.

BACKGROUND

In order to facilitate the use of earphones, earphones or Bluetooth earphones are placed on hats or headbands. In the prior art, earphones are generally connected by wires. With the advent of Bluetooth earphones, most hats or headbands use Bluetooth earphones.

However, it is inconvenient to disassemble the earphone when the existing earphone on the hat or headband is in use. When the hat or headband needs to be cleaned, it is more troublesome to disassemble the earphone. Moreover, after the earphone is used for a long time, it is easy for dust to fall into the earphone, it is inconvenient to disassemble the existing earphone itself, and it is inconvenient to clean the earphone.

SUMMARY

The object of the present disclosure is to provide a detachable earphone and a headband with earphones, so as to solve the problems mentioned in the background.

In order to solve the above technical problems, the present disclosure provides the following technical solutions: a detachable earphone, comprising an earphone body and an installing base, wherein: one side of the earphone body is provided with a clamping base on the same body, one side of the installing base is provided with an installing ring that matches with the clamping base, and the clamping base is clamped on the side wall of the installing ring.

Preferably, the outer side of the clamping base is provided with an L-shaped neck, and a clamping block is fixedly installed on the side wall of the installing ring. Three L-shaped necks and clamping blocks are provided respectively, which are evenly distributed.

Preferably, the other side of the installing base is provided with a conical clamping ring protruding to the inside of the installing base.

Preferably, a convex cylinder is fixedly installed in the middle of one end of the clamping base away from the earphone body.

Preferably, sound holes are provided on the outer sides of the clamping base and the convex cylinder.

A headband with earphones is provided, wherein: the outer side of the headband is provided with an installing hole for installing the installing base of the earphone, and the inner cavity of the installing hole is sewn with a placement cavity for placing the installing base through threads.

Compared with the prior art, the beneficial effects of the present disclosure are as follows.

The present disclosure is provided with an installing base, a clamping base, an installing ring, an L-shaped neck and a clamping block, so that it is more convenient to install and disassemble the earphone body and the installing base, and it facilitates cleaning the inside of the earphone body. The installing base is installed in the installing hole of the headband, which is convenient to disassemble the installing base. The earphone body is located inside the installing base, and the installing base plays a role of dust prevention and protection for the earphone body.

In the figures: 1. Earphone body; 2. Convex cylinder; 3. L-shaped neck; 4. Clamping base; 5. Sound hole; 6. Installing base; 7. Installing ring; 8. Clamping block; 9. Conical clamping ring; 10. Headband; 11. Installing hole; 12. Thread.

DESCRIPTION OF THE EMBODIMENTS

The technical solutions in the embodiments of the present disclosure will be clearly and completely described with reference to the accompanying drawings in the embodiments of the present disclosure. Obviously, the described embodiments are only a part of the embodiments of the present disclosure, rather than all the embodiments. Based on the embodiments of the present disclosure, all other embodiments obtained by those skilled in the art without creative work shall fall within the protection scope of the present disclosure.

Figure 1:
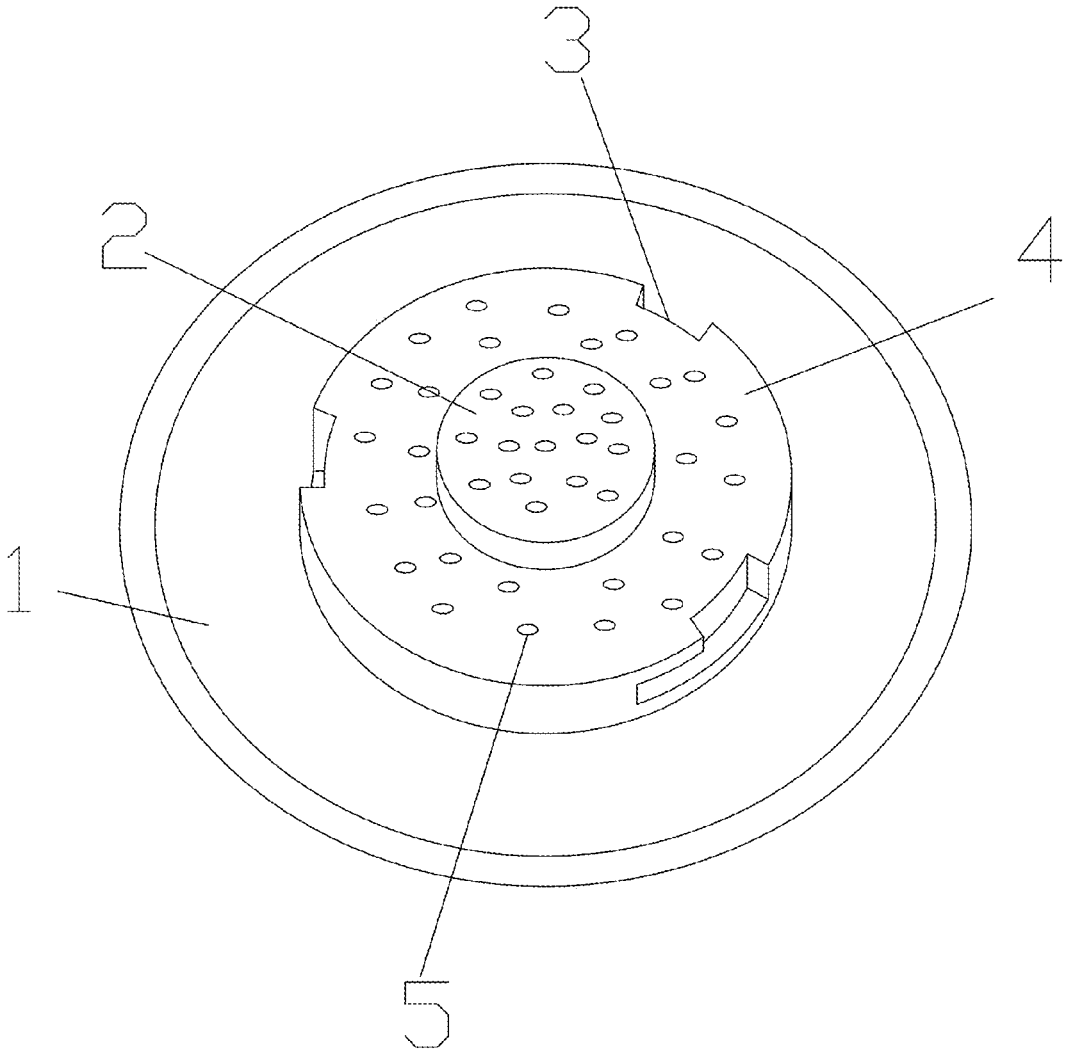
FIG. 1 is a schematic diagram of the structure of an earphone body according to the present disclosure.
Figure 2:
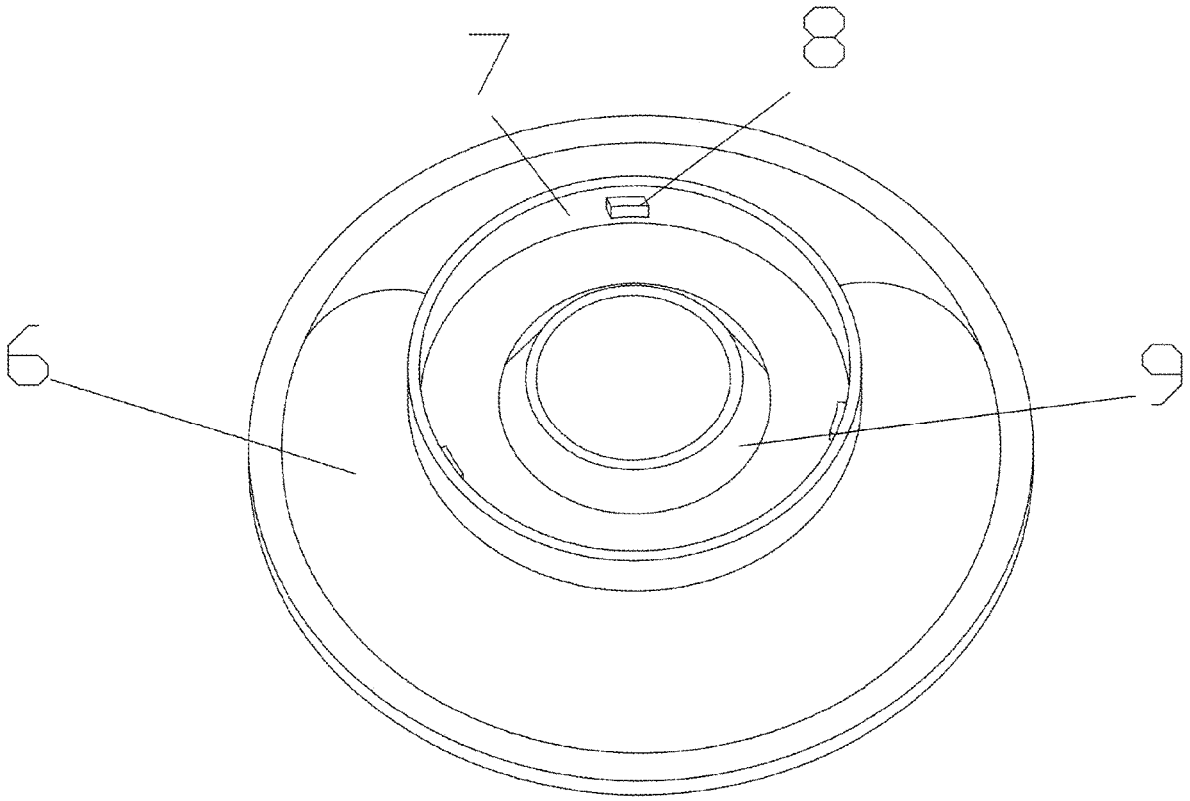
FIG. 2 is a schematic diagram of the structure of an installing base according to the embodiment of the present disclosure.
Figure 3:
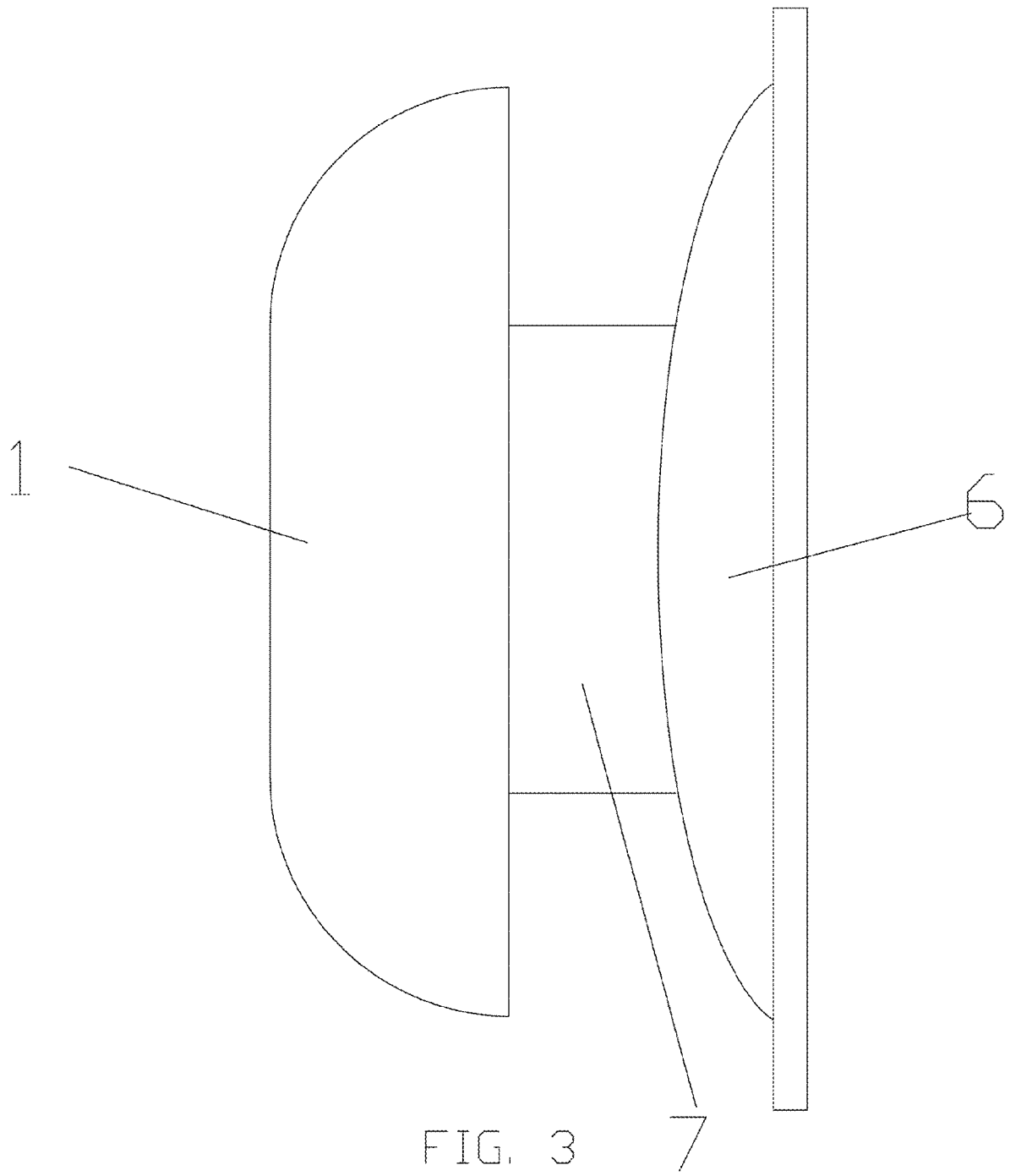
FIG. 3 is a left side diagram of an earphone body and an installing base which are clamped according to the embodiment of the present disclosure.
Figure 4:
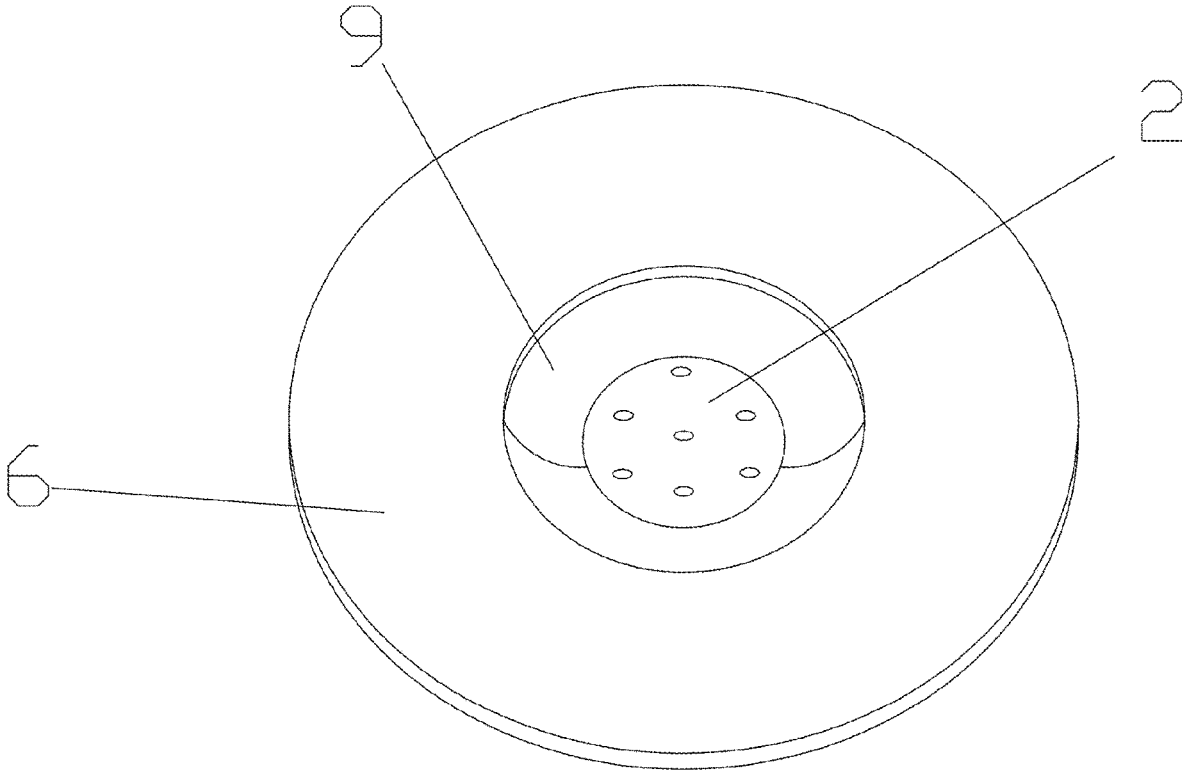
FIG. 4 is a bottom diagram of an earphone body and an installing base which are clamped according to the present disclosure.

Referring to FIGS. 1-4, this embodiment provides a detachable earphone, comprising an earphone body 1 and an installing base 6. The side of the installing base 6 in contact with the earphone body 1 is provided with an arc-shaped protrusion structure. One side of the earphone body 1 is provided with a clamping base 4 on the same body. One side of the installing base 6 is provided with an installing ring 7 that matches with the clamping base 4. The clamping base 4 is clamped on the side wall of the installing ring 7. The clamping base 4 is clamped with the installing ring 7 to facilitate the disassembly of the earphone body 1.

The outer side of the clamping base 4 is provided with an L-shaped neck 3, and a clamping block 8 is fixedly installed on the side wall of the installing ring 7. When the clamping base 4 and the installing ring 7 are installed together, the clamping block 8 slides from the opening of the L-shaped neck 3 to the bottom of the L-shaped neck 3, and then the clamping base 4 is rotated so that the clamping block 8 is rotated to the innermost side of the L-shaped neck 3 to complete the installation of the clamping base 4 and the installing ring 7, so as to install the installing base 6 and the earphone body 1 together. The clamping base 4 is located inside the installing base 6, and the installing base 6 can play a role of dust prevention and prevent dust from falling into the earphone body 1. When the earphone body 1 needs to be cleaned, it is only necessary to rotate the clamping base 4 in the reverse direction, and then the clamping block 8 is detached from the L-shaped neck 3 to separate the clamping base 4 from the installing ring 7, which is convenient to clean the earphone body 1.

Preferably, Three L-shaped necks 3 and clamping blocks 8 are provided respectively, which are evenly distributed.

In this embodiment, the shape of the clamping block 8 is not limited. The clamping block 8 can be an elliptical structure, a cylindrical structure or a waist structure, as long as it can be clamped into the L-shaped neck 3.

The other side of the installing base 6 is provided with a conical clamping ring 9 protruding to the inside of the installing base 6. A convex cylinder 2 is fixedly installed in the middle of one end of the clamping base 4 away from the earphone body 1. When the earphone body 1 and the installing base 6 are clamped together, the convex cylinder 2 is just clamped into the inside of the conical clamping ring 9, and the conical clamping ring 9 is in contact with the ear, which can play a role of protecting the ear. At the same time, the conical clamping ring 9 also has the sound pickup effect, so that the sound effect of the earphone is better, solving the problem that the sound pickup effect of the existing earphone is poor.

In this embodiment, in order to make the sound transmission effect of the earphone better, sound holes 5 are provided on the outer sides of the clamping base 4 and the convex cylinder 2.

Figure 5:
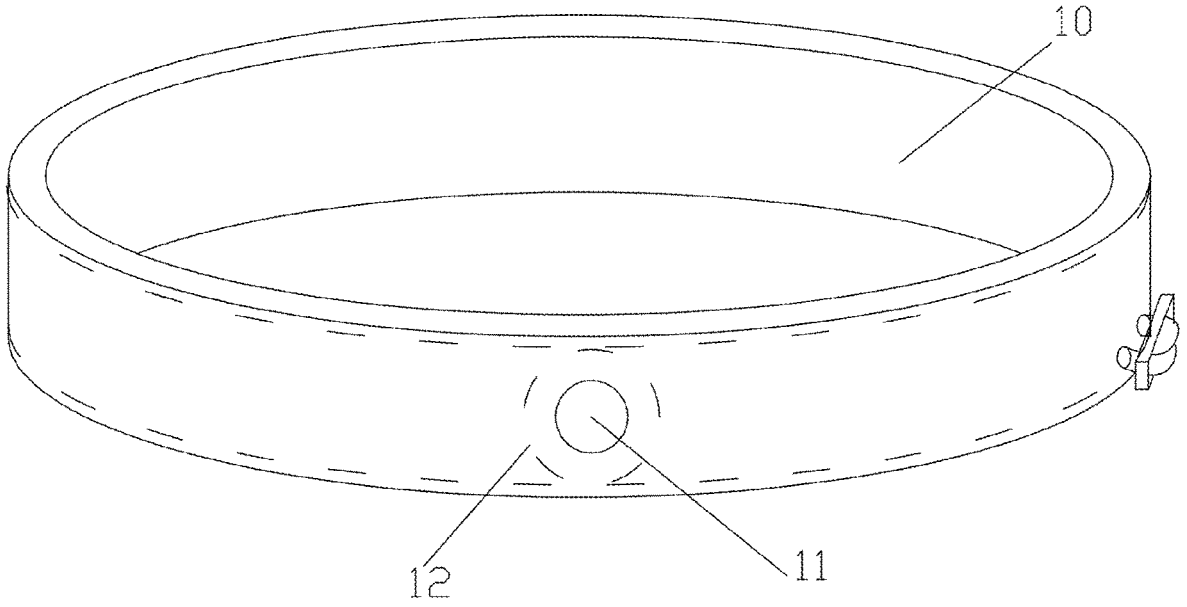
FIG. 5 is a schematic diagram of the structure of a headband according to the present disclosure.

Referring to FIGS. 1-5, a headband with earphones is provided. The outer side of the headband 10 is provided with an installing hole 11 for installing the installing base 6 of the earphone, and the inner cavity of the installing hole 11 is sewn with a placement cavity for placing the installing base 6 through threads 12.

The placement cavity has a circular structure, which can prevent the installing base 6 from shaking inside the placement cavity and ensure the stability of the installing base 6. Moreover, when the installing base 6 is installed inside the installing hole 11, the outside of the installing ring 7 is in contact with the inside of the installing hole 11, so that the earphone body 1 is more stable inside the installing hole 11.

In order to ensure that the headband 10 can adapt to people of different head sizes, elastic bands or rubber bands are placed between the inner and outer layers of the headband 10. The rubber bands or elastic bands pass through the outer layer of the headband 10, and the rubber bands or elastic bands exposed outside are installed with buckles for adjusting the degree of tightness of the rubber bands or elastic bands.

When the earphone needs to be cleaned, the installing base 6 can be taken out of the installing hole 11, and then the earphone body 1 is separated from the installing base 6 to clean the inside of the earphone body 1.

In addition to being placed on the headband, the earphone can also be placed on the hat.

Although the embodiments of the present disclosure have been shown and described, for those skilled in the art, it will be understood that various changes, modifications, replacements and variants can be made to these embodiments without departing from the principle and spirit of the present disclosure, and the scope of the present disclosure is defined by the appended claims and their equivalents.

What is claimed is:

1. A detachable earphone, comprising an earphone body (1) and an installing base (6), wherein: one side of the earphone body (1) is provided with a clamping base (4) on the same body, one side of the installing base (6) is provided with an installing ring (7) that matches with the clamping base (4), and the clamping base (4) is clamped on the side wall of the installing ring (7), the outer side of the clamping base (4) is provided with an L-shaped neck (3), and a clamping block (8) is fixedly installed on the side wall of the installing ring (7), the clamping block is capable of being engaged with the L-shaped neck (3) to mount the clamping base and the installing ring together.

2. The detachable earphone according to claim 1, wherein: the other side of the installing base (6) is provided with a conical clamping ring (9) protruding to the inside of the installing base (6).

3. The detachable earphone according to claim 2, wherein: a convex cylinder (2) is fixedly installed in the middle of one end of the clamping base (4) away from the earphone body (1).

4. The detachable earphone according to claim 3, wherein: sound holes (5) are provided on the outer sides of the clamping base (4) and the convex cylinder (2), when the earphone body (1) and the installing base (6) are clamped together, the convex cylinder (2) is just clamped into an inside of the conical clamping ring (9).

5. A headband with a detachable earphone, wherein: the detachable earphone comprises an earphone body (1) and an installing base (6), one side of the earphone body (1) is provided with a clamping base (4) on the same body, one side of the installing base (6) is provided with an installing ring (7) that matches with the clamping base (4), and the clamping base (4) is clamped on the side wall of the installing ring (7), the outer side of the clamping base (4) is provided with an L-shaped neck (3), and a clamping block (8) is fixedly installed on the side wall of the installing ring (7), the clamping block is capable of being engaged with the L-shaped neck (3) to mount the clamping base and the installing ring together, the outer side of the headband (10) is provided with an installing hole (11) for installing the installing base (6) of the earphone, and an inner cavity of the installing hole (11) is sewn with a placement cavity for placing the installing base (6) through threads (12).

* * * * *